US007218281B2

(12) United States Patent
Sievenpiper et al.

(10) Patent No.: US 7,218,281 B2
(45) Date of Patent: May 15, 2007

(54) ARTIFICIAL IMPEDANCE STRUCTURE

(75) Inventors: Daniel F. Sievenpiper, Santa Monica, CA (US); Joseph S. Colburn, Malibu, CA (US); Bryan Ho Lim Fong, Los Angeles, CA (US); Matthew W. Ganz, Marina del Rey, CA (US); Mark F. Gyure, Oak Park, CA (US); Jonathan J. Lynch, Oxnard, CA (US); John Ottusch, Malibu, CA (US); John L. Visher, Malibu, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 11/173,187

(22) Filed: Jul. 1, 2005

(65) Prior Publication Data

US 2007/0001909 A1 Jan. 4, 2007

(51) Int. Cl.
*H01Q 1/38* (2006.01)

(52) U.S. Cl. ..... 343/700 MS; 343/909

(58) Field of Classification Search ..... 343/700, 343/909, 700 MS
See application file for complete search history.

(56) References Cited

U.S. PATENT DOCUMENTS 5,917,458 A 6/1999 Ho et al. ..... 343/909
6,208,316 B1 * 3/2001 Cahill ..... 343/909
6,483,481 B1 11/2002 Sievenpiper et al. ..... 343/909
6,518,931 B1 * 2/2003 Sievenpiper ..... 343/770
2006/0152430 A1 * 7/2006 Seddon et al. ..... 343/909

OTHER PUBLICATIONS

Checcacci, V., et al., "Holographic Antennas", *IEEE Transactions on Antennas and Propagation*, vol. 18, No. 6, pp. 811-813, Nov. 1970.
Fathy, A.E., et al., "Silicon-Based Reconfigurable Antennas—Concepts, Analysis, Implementation and Feasibility", *IEEE Transactions on Microwave Theory and Techniques*, vol. 51, No. 6, pp. 1650-1661, Jun. 2003.
King, R., et al., "The Synthesis of Surface Reactance Using an Artificial Dielectric", *IEEE Transactions on Antennas and Propagation*, vol. 31, No. 3, pp. 471-476, May 1993.
Levis, K., et al., "Ka-Band Dipole Holographic Antennas", *IEEE Proceedings of Microwaves, Antennas and Propagation*, vol. 148, No. 2, pp. 129-132, Apr. 2001.
Mitra, R., et al., Techniques for Analyzing Frequency Selective Surfaces—A Review, *Proceedings of the IEEE*, vol. 76, No. 12, pp. 1593-1615, Dec. 1988.
Oliner, A., et al., "Guided waves on sinusoidally-modulated reactance surfaces", *IEEE Transactions on Antennas and Propagation*, vol. 7, No. 5, pp. 201-208, Dec. 1959.
Pease, R., "Radiation from Modulated Surface Wave Structures II" *IRE International Convention Record*, vol. 5, pp. 161-165, Mar. 1957.

(Continued)

*Primary Examiner*—Hoang V. Nguyen
*Assistant Examiner*—Dieu Hien Duong
(74) *Attorney, Agent, or Firm*—Ladas & Parry

(57) ABSTRACT

A method for guiding waves over objects, a method for improving a performance of an antenna, and a method for improving a performance of a radar are disclosed. The methods disclosed teach how an impedance structure can be used to guide waves over objects.

13 Claims, 7 Drawing Sheets

OTHER PUBLICATIONS

Sazonov, D.M., "Computer Aided Design of Holographic Antennas and Propagation", *IEEE International Symposium of the Antennas and the Propagation Society 1999*, vol. 2, pp. 738-741, Jul. 1999.
Sievenpiper, D., et al., "High-Impedance Electromagnetic Surfaces with a Forbidden Frequency Band", *IEEE Transactions on Micro wave Theory and Techniques*, vol. 47, No. 11, pp. 2059-2074, Nov. 1999.
Thomas, A., et al., "Radiation from Modulated Surface Wave Structures I", *IRE International Convention Record*, vol. 5, pp. 153-160, Mar. 1957.

* cited by examiner

ARTIFICIAL IMPEDANCE STRUCTURE

CROSS REFERENCE TO RELATED APPLICATIONS

This application is related to U.S. application Ser. No. 11/173,182, titled "Artificial Impedance Structures," filed on Jul. 1, 2005, which is incorporated herein by reference in its entirety.

FIELD OF THE INVENTION

The present invention relates to artificial impedance structures. More particularly, the present invention relates to propagating electromagnetic waves around solid objects using artificial impedance structures.

BACKGROUND

Figure 1A:
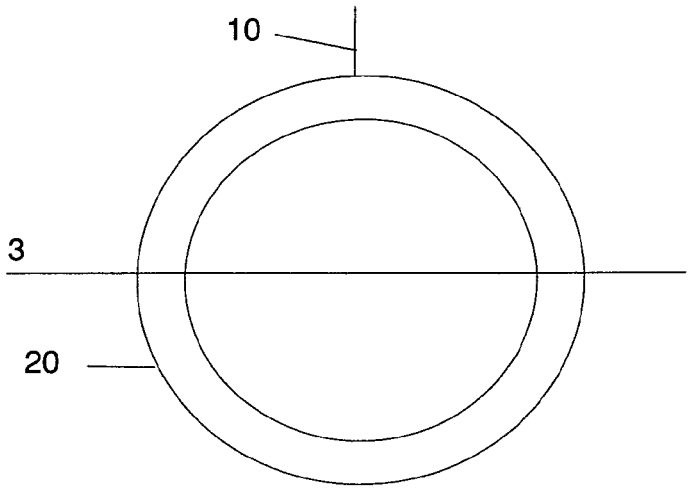
FIG 1a PRIOR ART
Figure 1B:
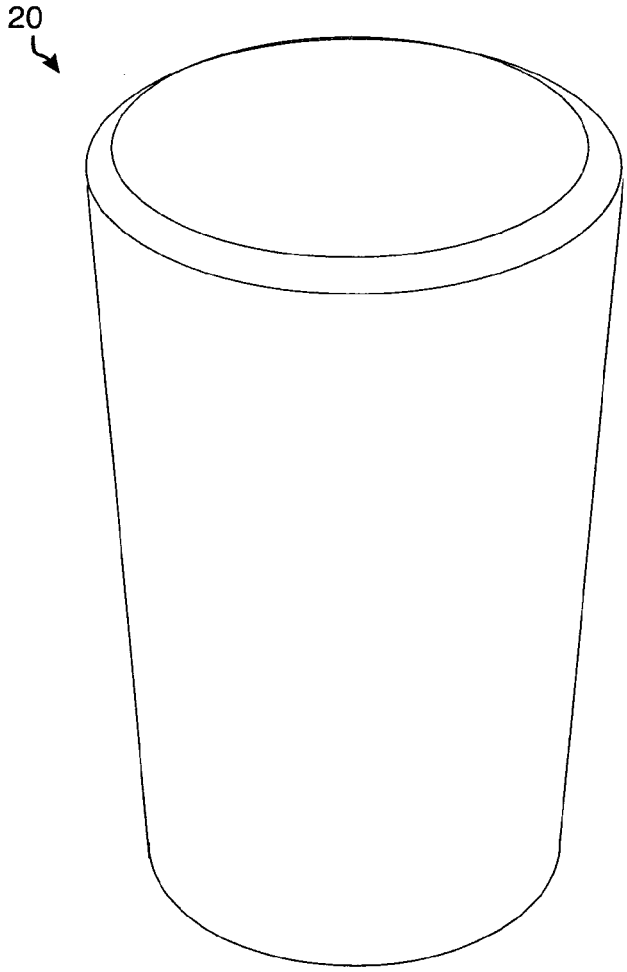
FIG 1b PRIOR ART
Figure 1C:
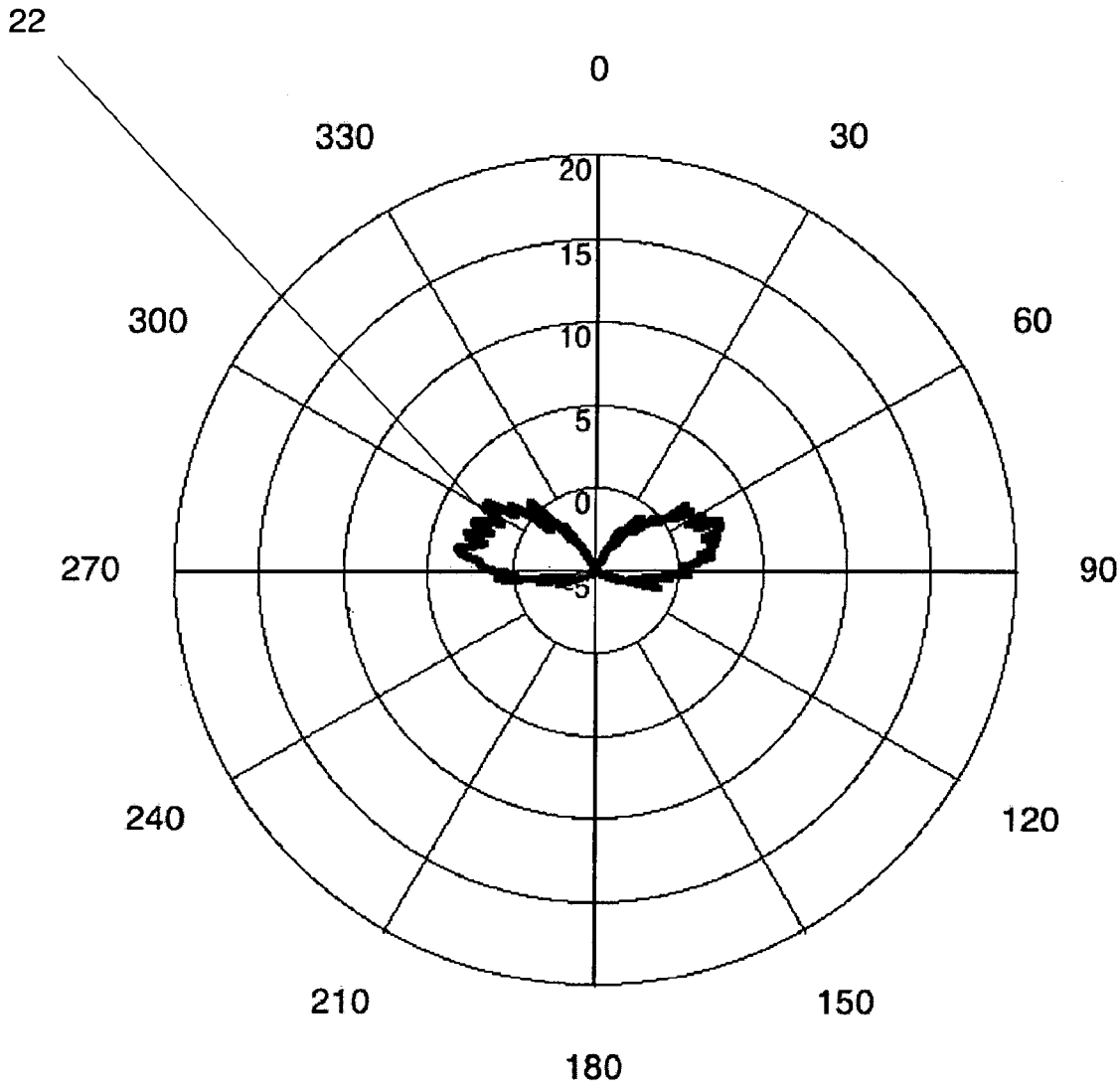
FIG 1c PRIOR ART

A common problem for antenna designers is creating antennas that are able to radiate energy at angles that are shadowed. For example, in Prior Art, a monopole antenna 10 on a conducting cylinder 20, as shown in FIGS. 1*a* and 1*b*, does not radiate energy below line 3 because the external surface of the cylinder 20 that is below line 3 is shadowed from the monopole antenna 10. FIG 1*c* shows the radiation pattern 22 produced by the cylinder 20 in FIGS. 1*a* and 1*b*.

PRIOR ART

The prior art consists of three main categories: (1) holographic antennas, (2) frequency selective surfaces and other artificial reactance surfaces, and (3) surface guiding by modulated dielectric or impedance layers.

Example of prior art directed to artificial antennas includes:

1. P. Checcacci, V. Russo, A. Scheggi, "Holographic Antennas", IEEE Transactions on Antennas and Propagation, vol. 18, no. 6, pp. 811–813, November 1970;
2. D. M. Sazonov, "Computer Aided Design of Holographic Antennas", IEEE International Symposium of the Antennas and Propagation Society 1999, vol. 2, pp. 738–741, July 1999;
3. K. Levis, A. Ittipiboon, A. Petosa, L. Roy, P. Berini, "Ka-Band Dipole Holographic Antennas", IEE Proceedings of Microwaves, Antennas and Propagation, vol. 148, no. 2, pp. 129–132, April 2001.

Example of prior art directed to frequency selective surfaces and other artificial reactance surfaces includes:

1. R. King, D. Thiel, K. Park, "The Synthesis of Surface Reactance Using an Artificial Dielectric", IEEE Transactions on Antennas and Propagation, vol. 31, no. 3, pp. 471–476, May, 1983;
2. R. Mittra, C. H. Chan, T. Cwik, "Techniques for Analyzing Frequency Selective Surfaces 13 A Review", Proceedings of the IEEE, vol. 76, no. 12, pp. 1593–1615, December 1988;
3. D. Sievenpiper, L. Zhang, R. Broas, N. Alexopolous, E. Yablonovitch, "High-Impedance Electromagnetic Surfaces with a Forbidden Frequency Band", IEEE Transactions on Microwave Theory and Techniques, vol. 47, no. 11, pp. 2059–2074, November 1999.

Example of prior art directed to surface guiding by modulated dielectric or impedance layers includes:

1. A. Thomas, F. Zucker, "Radiation from Modulated Surface Wave Structures I", IRE International Convention Record, vol. 5, pp. 153–160, March 1957;

2. R. Pease, "Radiation from Modulated Surface Wave Structures II", IRE International Convention Record, vol. 5, pp. 161–165, March 1957;
3. A. Oliner, A. Hessel, "Guided waves on sinusoidally-modulated reactance surfaces", IEEE Transactions on Antennas and Propagation, vol. 7, no. 5, pp. 201–208, December 1959.

Example of prior art directed to this general area also includes:

1. T. Q. Ho, J. C. Logan, J. W. Rocway "Frequency Selective Surface Integrated Antenna System", U.S. Pat. No. 5,917,458, Sep. 8, 1995;
2. A. E. Fathy, A. Rosen, H. S. Owen, f. McGinty, D. J. McGee, G. C. Taylor, R. Amantea, P. K. Swain, S. M. Perlow, M. ElSherbiny, "Silicon-Based Reconfigurable Antennas—Concepts, Analysis, Implementation and Feasibility", IEEE Transactions on Microwave Theory and Techniques, vol. 51, no. 6, pp. 1650–1661, June 2003.

BRIEF DESCRIPTION OF THE FIGS.

FIGS. 1*a* and 1*b* relate to Prior Art and depict a monopole antenna on a conducting cylinder, PRIOR ART;

FIG. 1*c* relates to Prior Art and depicts a low gain radiation patter generated by the conducting cylinder in FIGS. 1*a* and 1*b;*

Figure 2:
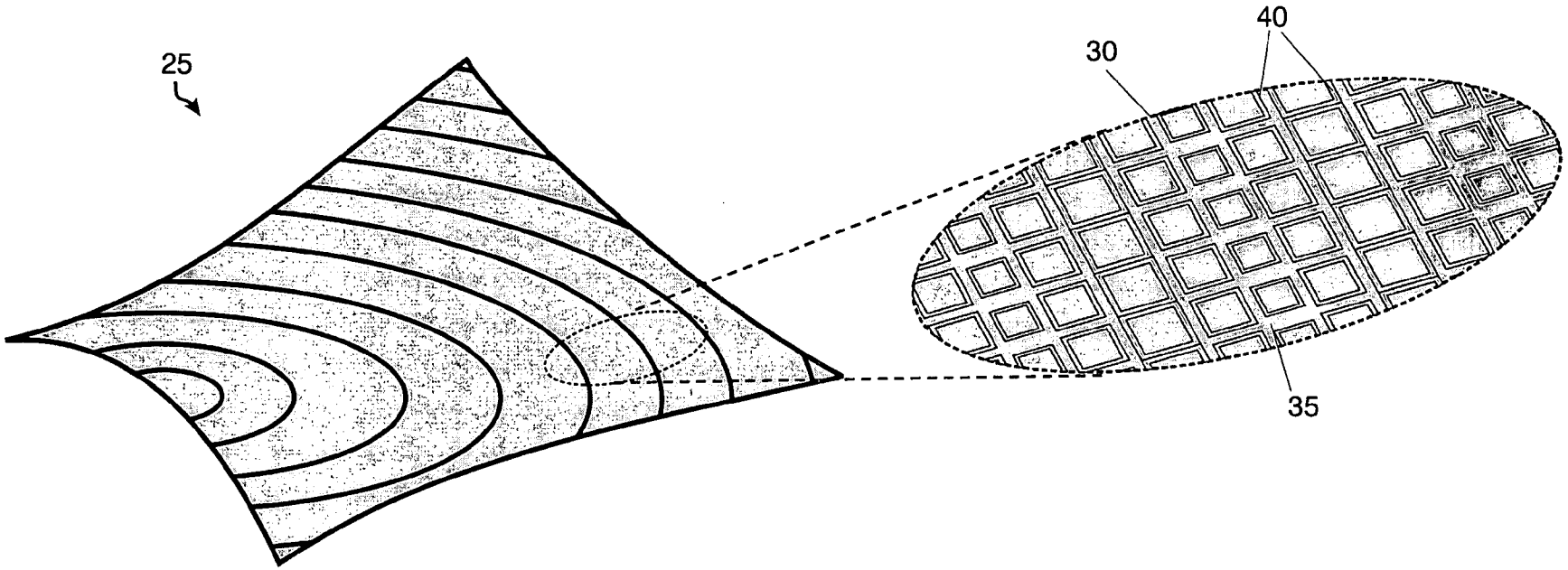
Figure 3A:
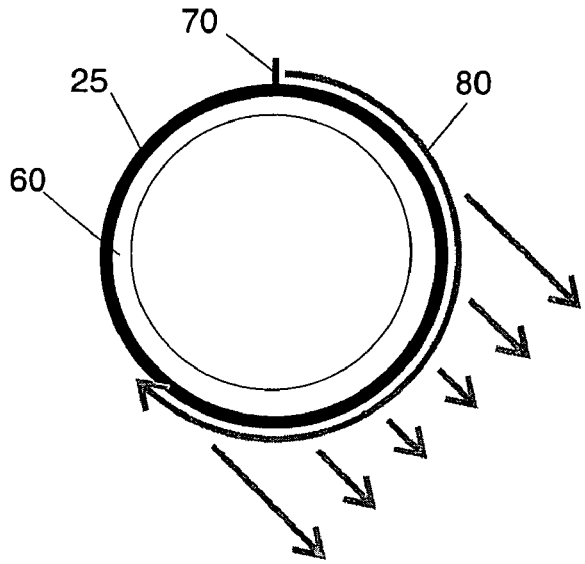
Figure 3B:
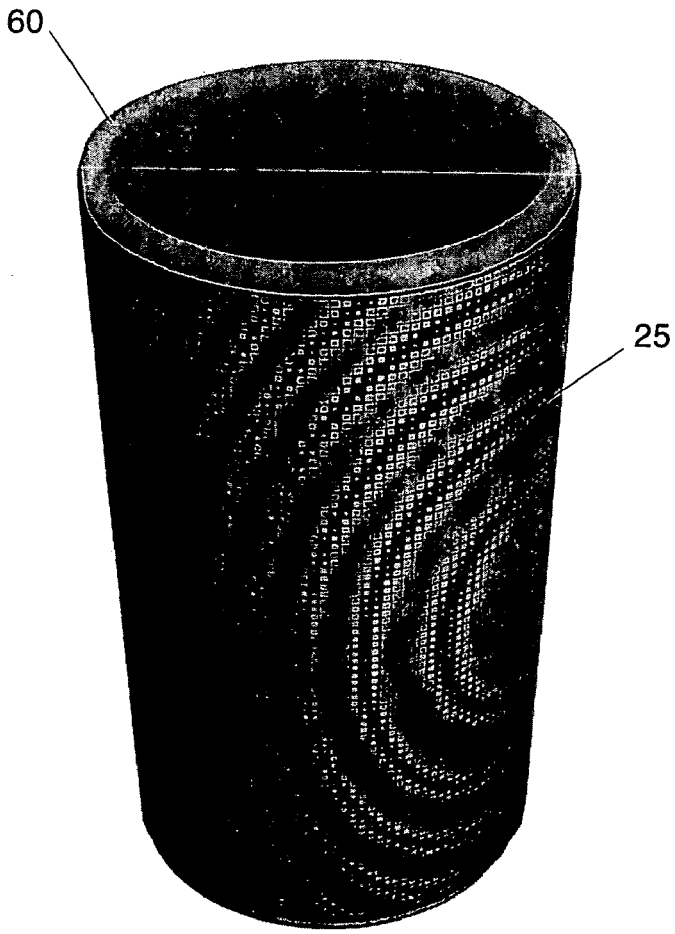
Figure 3C:
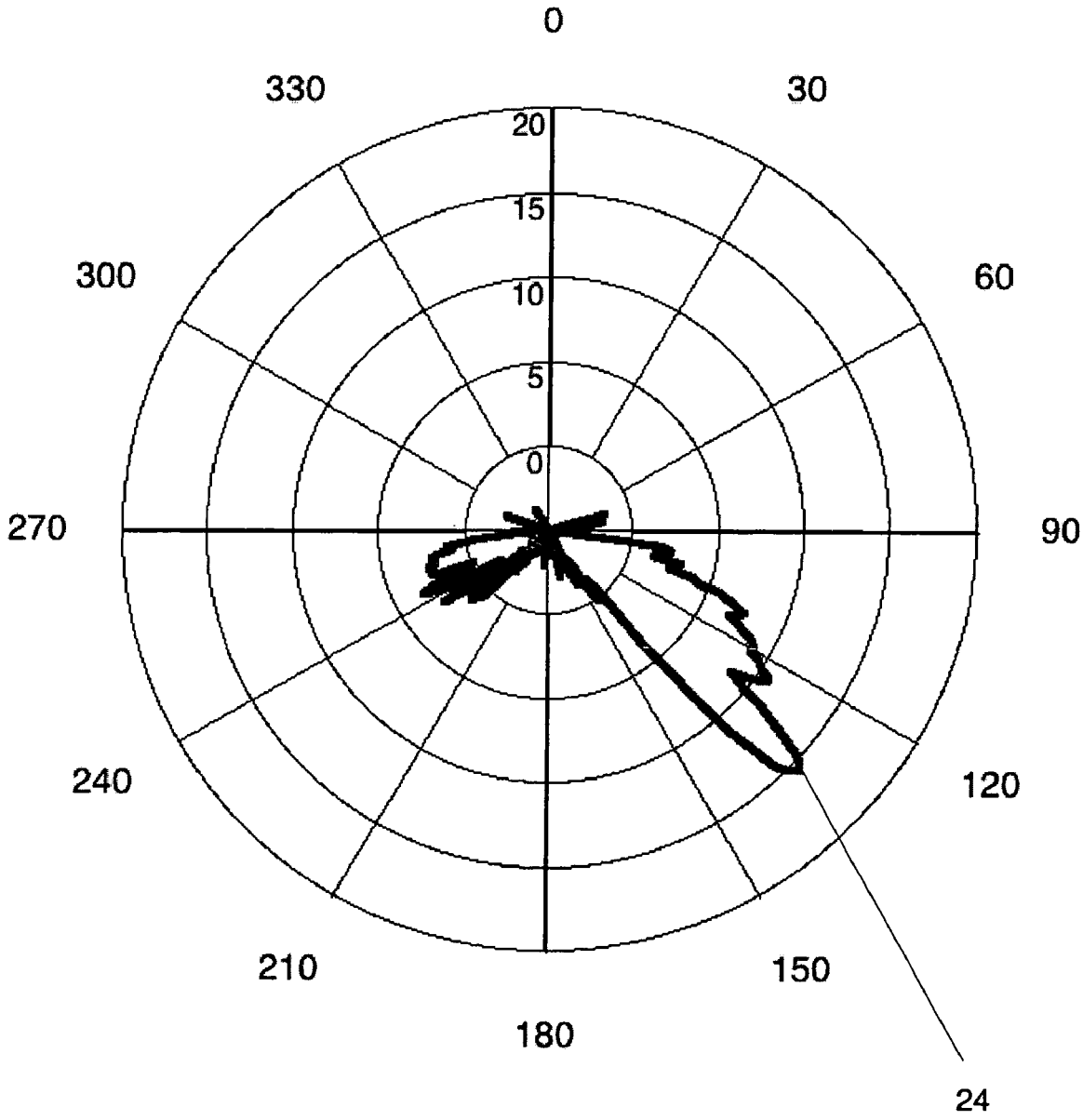
Figure 4A:
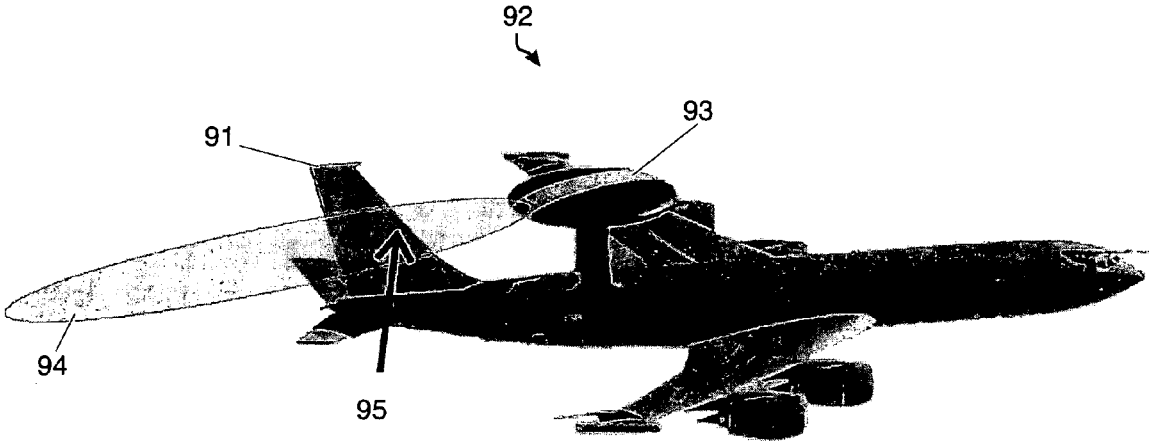
Figure 4B:
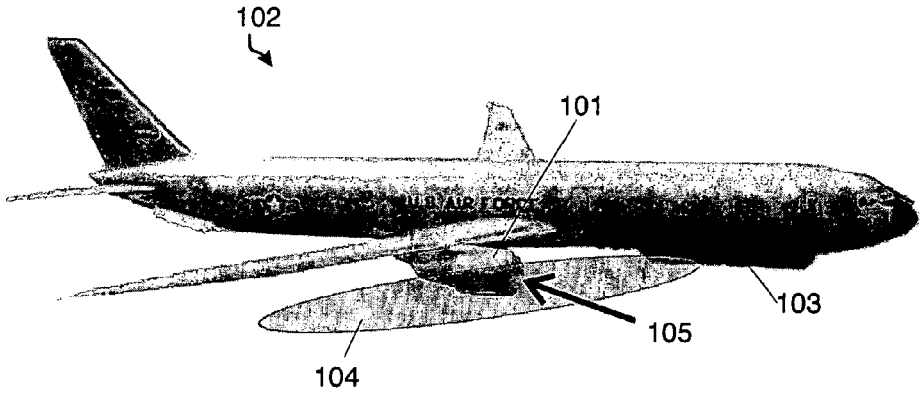
Figure 5A:
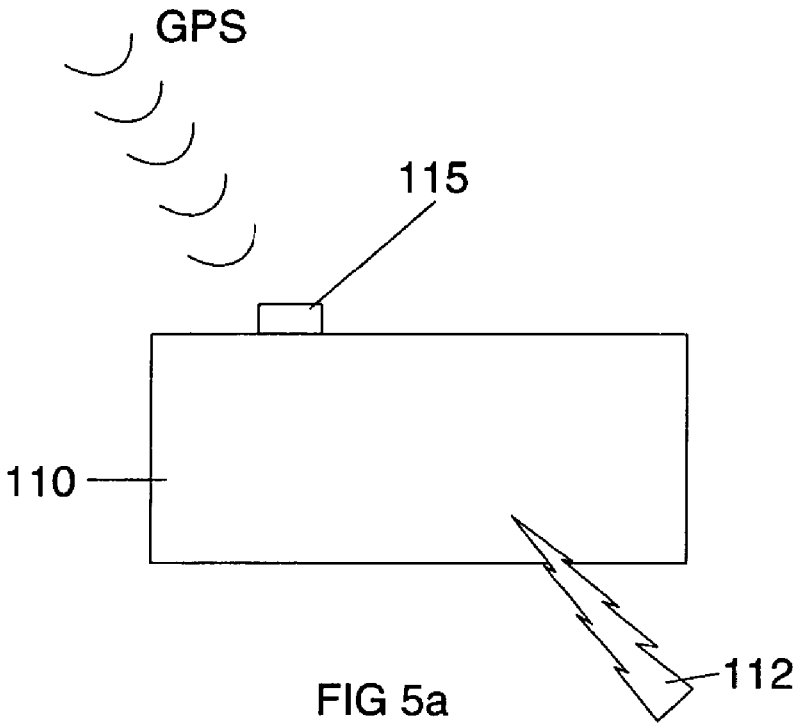
Figure 5B:
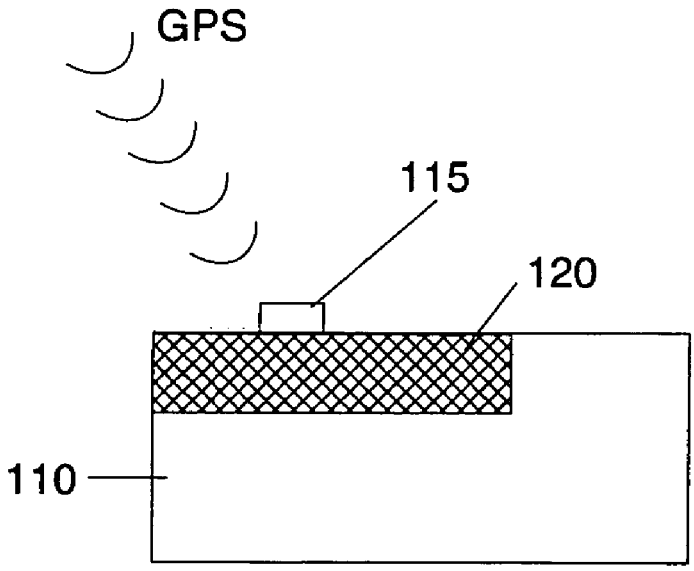

FIG. 2 depicts an artificial impedance structure;

FIGS. 3*a*–3*b* depict a monopole antenna on a cylinder covered by a artificial impedance structure in accordance with the present disclosure;

FIG. 3*c* depicts a high gain radiation patter generated by a cylinder in FIGS. 3*a* and 3*b* in accordance with the present disclosure;

FIG. 4*a* depicts a tail of an airplane covered by an artificial impedance structure in accordance with the present disclosure;

FIG. 4*b* depicts an engine of an airplane covered by an artificial impedance structure in accordance with the present disclosure;

FIG. 5*a* depicts an offensive device being affected by jamming signals; and FIG. 5*b* depicts an offensive device covered by an artificial impedance structure in accordance with the present disclosure.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

According to the present disclosure, artificial impedance structures may be placed over different surfaces to provide scattering or guiding properties desired by the antenna designer.

The artificial impedance structure may be designed to guide and radiate energy from the electromagnetic waves to produce any arbitrary radiation pattern. See, for example, a related application U.S. application Ser. No. 11/173,182, filed on Jul. 1, 2005, "Artificial Impedance Structures," which is incorporated herein by reference in its entirety.

Referring to FIG. 2, an artificial impedance structure 25 can be used to design antennas on curved shapes and to have radiation properties that would ordinarily be impossible. The artificial impedance structure 25 may contain an artificial impedance surface 30 that comprises conductive structures 40 printed on a grounded dielectric layer 35 that is thinner than the wavelength of operation.

The artificial impedance structure 25 may be applied to solid objects to guide waves around those objects. Because the methods described here can be used to transform one wave into another through surface wave coupling, by engineering the scattering properties of the surface, the same concept can be used if the source wave is an incoming plane wave or the radiation pattern of a nearby antenna. The artificial impedance structure 25 can be used to fill in nulls that would otherwise be created by the vehicle structure on which the antenna is mounted. The artificial impedance structure 25 can also be used to make better omnidirectional antennas that are not affected by the local environment. In one exemplary embodiment, the artificial impedance structure 25 may, for example, be built as a printed circuit board to be wrapped around an object that may be interfering the performance of an antenna.

Referring to FIGS. 3*a* and 3*b*, the artificial impedance structure 25 was placed over a cylinder 60 to enable a monopole antenna 70 disposed on the cylinder 60 to produce a narrow beam on the opposite side of the cylinder 60, toward a direction that is otherwise shadowed. The monopole antenna 70 generates surface currents 80 that propagate along the artificial impedance structure 25 and around the cylinder 60. The artificial impedance structure 25 was designed using the interference pattern formed by the surface currents, and a plane wave at 135 degrees on the opposite side of the cylinder 60. The radiation pattern 24 in FIG. 3*c* of the artificial impedance structure 25 disposed on the cylinder 60 showed a narrow beam at 135 degrees.

The artificial impedance structure may also be used to guide incoming plane waves around a solid object. For example, the artificial impedance structure may make portions of an airplane transparent to radiation for greater radar scan range. Referring to FIG. 4*a*, a tail 91 of an airplane 92 may be covered by an artificial impedance structure 95 to allow the radar 93 to see through the tail 91. Referring to FIG. 4*b*, an engine 101 of an airplane 102 may be covered by an artificial impedance structure 105 to allow the radar 103 to see through the engine 101. The waves 94 and 104 do not actually pass through the tail 91 and the engine 101, respectively, but are guided around the tail 91 and the engine 101 by the artificial impedance structure 95 and 101, respectively, and re-radiate from the other side.

Using the concepts described above, an artificial impedance structure may also be designed and used to suppress certain incoming electromagnetic waves from propagating around a solid object. Referring to FIG. 5*a*, a GPS (global position system) guided offensive device 110 is susceptible to jammer signals 112 coming from the ground because the surface of the offensive device 110 may propagate the jammer signals 112 to the GPS receiver 115. Referring to FIG. 5*b*, an artificial impedance structure 120 may be placed on the portion of the offensive device 110 surrounding the GPS receiver 115. The artificial impedance designed to only propagate radiation from above the horizon thus making the device 110 more resistant to jammers. The device 110 may be an offensive device.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . . "

What is claimed is:

1. A method for guiding waves over the surface of an object, said method comprising:

providing an impedance structure designed to guide an electromagnetic wave, the impedance structure having:

a dielectric layer having generally opposed first and second surfaces;

a conductive layer disposed on the first surface; and a plurality of conductive structures disposed on the second surface to provide a preselected impedance profile along the second surface;

covering said object with said impedance structure, wherein said impedance structure guides said electromagnetic wave over the surface of said object.

2. The method of claim 1, wherein said electromagnetic wave is an incoming plane wave or a radiation pattern of an antenna.

3. The method of claim 1, wherein said electromagnetic wave is guided by said impedance structure to a preselected location.

4. The method of claim 1, wherein said electromagnetic wave is guided by said impedance structure away from a preselected location.

5. The method of claim 1, wherein said impedance structure is a printed circuit board.

6. A method for altering performance of an antenna, said method comprising:

providing an impedance structure designed to guide an electromagnetic wave, the impedance structure having:

a dielectric layer having generally opposed first and second surfaces;

a conductive layer disposed on the first surface; and a plurality of conductive structures disposed on the second surface to provide a preselected impedance profile along the second surface;

covering a surface interfering with performance of an antenna with said impedance structure, wherein said impedance structure guides electromagnetic waves generated by said antenna over said surface.

7. The method of claim 6, wherein at least a portion of said electromagnetic waves generated by said antenna are radiated by said impedance structure.

8. The method of claim 7, wherein electromagnetic waves radiated by said impedance structure are radiated at a preselected location.

9. The method of claim 7, wherein electromagnetic waves radiated by said impedance structure are radiated away from a preselected location.

10. A method for improving performance of a radar, said method comprising:

providing an impedance structure designed to guide electromagnetic waves, the impedance structure having:

a dielectric layer having generally opposed first and second surfaces;

a conductive layer disposed on the first surface; and a plurality of conductive structures disposed on the second surface to provide a preselected impedance profile along the second surface;

covering a surface, blocking said radar, with said impedance structure, wherein said impedance structure guides and radiates electromagnetic waves over said surface, wherein said impedance structure guides and radiates incoming electromagnetic waves over said surface to said radar.

11. The method of claim 10, wherein said electromagnetic waves are generated by said radar.

12. The method of claim 1, wherein the preselected impedance profile is non-uniform along the second surface.

13. The method of claim 6, wherein the preselected impedance profile is non-uniform along the second surface.

* * * * *